US006471732B1

(12) United States Patent
Shimada

(10) Patent No.: US 6,471,732 B1
(45) Date of Patent: Oct. 29, 2002

(54) WATER-IN-OIL TYPE EMULSION FUEL OIL

(75) Inventor: Yoshinari Shimada, 9-1, Asashigaoka 2-chome, Asaka-city, Saitama-prefecture 351-0035 (JP)

(73) Assignees: Kuretake Co., Ltd. (JP); Yoshinari Shimada (JP); Tadanao Shimada (JP)

( * ) Notice: Subject to any disclaimer, the term of this patent is extended or adjusted under 35 U.S.C. 154(b) by 0 days.

(21) Appl. No.: 09/720,969

(22) PCT Filed: Jul. 3, 1998

(86) PCT No.: PCT/JP98/03003

§ 371 (c)(1),
(2), (4) Date: Jan. 3, 2001

(87) PCT Pub. No.: WO00/01789

PCT Pub. Date: Jan. 13, 2000

(51) Int. Cl.[7] ..... C10L 1/32
(52) U.S. Cl. ..... 44/281; 44/301
(58) Field of Search ..... 44/281, 301

(56) References Cited

U.S. PATENT DOCUMENTS 4,744,797 A * 5/1988 Shimada et al. ..... 44/281
4,842,616 A * 6/1989 Verhille ..... 44/281
5,851,245 A * 12/1998 Moriyama et al. ..... 44/301
6,030,424 A * 2/2000 Matsumoto ..... 44/301

FOREIGN PATENT DOCUMENTS

JP 6-93276 4/1994
JP 6-145675 5/1994

* cited by examiner

*Primary Examiner*—Margaret Medley
(74) *Attorney, Agent, or Firm*—Parkhurst & Wendel, L.L.P.

(57) ABSTRACT

A water-in-oil type emulsion fuel oil is prepared by dispersing and emulsifying in heavy oil a water/carbon mixture prepared by dispersing carbon fine particles in water with a dispersant and a protective colloid. The emulsion fuel oil includes 100 vol % of heavy oil and 20 to 45 vol % of the water/carbon mixture. Water particles are uniformly dispersed and emulsified in the heavy oil in the form of particles having diameters exceeding 20 $\mu$m but not exceeding 35 $\mu$m, and when the amount of the water/carbon mixture to be mixed with 100 vol % of the heavy oil is 20 to 35 vol %, the dispersed water particles have diameters ranging from 25 to 35 $\mu$m, while when the amount is 35 to 45 vol %, they have diameters of from more than 20 $\mu$m to 25 $\mu$m. Because, in this emulsified fuel oil, flame temperature does not change in comparison with the heavy oil combustion to which water is not add, this emulsified fuel oil is extremely advantageous in view of a heat balance. Since oil to be combusted is decreased, $CO_2$ to be exhausted is decreased, thereby it is effective in inhibiting global warming.

6 Claims, 1 Drawing Sheet

WATER-IN-OIL TYPE EMULSION FUEL OIL

TECHNICAL FIELD

The present invention relates to a water-in-oil type emulsified fuel oil in which water is dispersed in heavy oil and more particularly relates to a water-in-oil type emulsified fuel oil which can contribute to energy-saving and reduction in discharge of carbon dioxide for inhibiting global warming.

BACKGROUND ART

An emulsified fuel oil containing water in the form of fine particles dispersed in heavy oil has conventionally come to public notice and has been tested since such an emulsified fuel oil has an effect on saving of combustion costs of heavy oil, decrease in NOx and SOx in combustion exhaust gas, and the like. In addition, in recent years, reduction in discharge of carbon dioxide ($CO_2$) has become urgent business also in combustion of fuel oil based on view points of energy-saving and prevention of global warming.

As a conventional production method of emulsified fuel oil, there has been proposed a method in which water is dispersed in heavy oil using a surface active agent as an emulsifier. As emulsification methods, there have been known a method by a static mixer, a method in which water is jetted out into oil, a method by mechanical agitation, a method by a supersonic wave, etc.

When a surface active agent is used as an emulsifier, emulsification is simple. However, water tends to separate partially in emulsified fuel oil during a heating storage. If separated water is generated, it defectively causes a trouble at the time when such an emulsified fuel oil is subjected to combustion. Therefore, emulsified fuel oil has been put in practical use only tentatively in the past though many studies on emulsified fuel oil have been made. In addition, a ratio of water to be added is at most 10%, and generally less than or equal to several %, and it has not been tried to use a quantity more than this because a trouble is prone to be caused. Therefore, an economic effect of energy-saving was not able to be expected very much.

Further, as for heavy oil, there are various kinds of heavy oil such as A heavy oil, B heavy oil, C heavy oil and heavy residue oil containing asphaltene, heavy metals, resins in affluence. However, there has recently been a strong request that only C heavy oil and heavy oil such as the residue oil which is heavier than C heavy oil is intended for combustion with boilers or the like, and the other kinds of heavy oil should be used for other uses.

However, in the case that C heavy oil and heavy oil such as heavy residue oil heavier than C heavy oil is subjected to the above conventional method in which dispersion is performed using water and a surface active agent, and a tendency of separation of water and heavy oil becomes further strong, and the practical use has been extremely difficult.

In view of the aforementioned situation, the present inventor proposed a production method of an emulsified fuel oil in which water having a carbon component dispersed therein is dispersed and emulsified in heavy oil in order to improve the above conventional emulsified fuel oil (See JP-A 6-145675).

The object of the present invention is to provide an emulsified fuel oil having further improved uniform dispersibility of waterdrops, combustion efficiency, reduction in discharge of carbon dioxide, and the like, in comparison with such conventional art. More specifically, the present invention provides an emulsified fuel oil having good combustion efficiency and capable of reducing discharge of carbon dioxide as well, and the emulsification-dispersion of water to heavy oil is easy and secure, and the emulsified fuel oil to be produced is stable for a long term without causing water to separate, isolate, or the like, and can contain water abundantly in comparison with the conventional one.

DISCLOSURE OF THE INVENTION

According to the present invention, there is provided a water-in-oil type emulsion fuel oil, prepared by dispersing and emulsifying in a heavy oil a water/carbon mixture prepared by dispersion carbon fine particles in water with a dispersant and a protective colloid, the emulsion fuel comprising 100 vol % of a heavy oil and 20 to 45 vol % of the water/carbon mixture, the water being uniformly dispersed and emulsified in the heavy oil in the form of particles having diameters of from more than 20 $\mu$m to 35 $\mu$m, and when the amount of the water/carbon mixture to be mixed with 100 vol % of the heavy oil is 20 to 35 vol %, the dispersed water particles have diameters ranging from 25 to 35 $\mu$m, while when the amount is 35 to 45 vol %, they have diameters of from more than 20 $\mu$m to 25 $\mu$m.

BEST MODE FOR CARRYING OUT THE INVENTION

Figure 1:
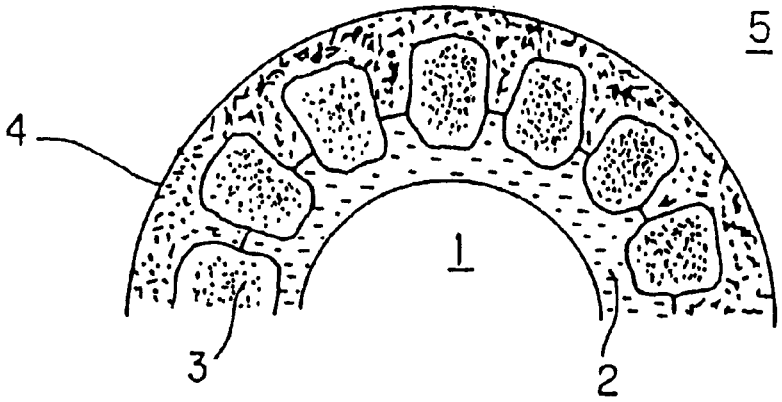
FIG. 1 is the conception diagram schematically showing a state of circumference of a water particle in emulsified fuel oil of the present invention.

The present invention uses a water/carbon mixture component prepared by dispersing carbon fine particles in water with a dispersant and a protective colloid, and water-in-oil type emulsified fuel oil is obtained by dispersing and emulsifying the water/carbon mixture component in heavy oil.

In emulsified fuel oil, 20–45 vol % of a water/carbon mixture component is mixed with 100 vol % of a heavy oil. The water particles dispersed and emulsified in heavy oil have diameters of from more than 20 $\mu$m to 35 $\mu$m, and the water/carbon mixture is agitated and dispersed so that the dispersed water particles have diameters ranging from 25 $\mu$m to 35 $\mu$m when the ratio of the water/carbon mixture to be mixed to 100 vol % of the heavy oil is 20 to 35 vol %, while they have diameters of from more than 20 $\mu$m to 25 $\mu$m when the ratio is 35 to 45 vol %, and water particles are uniformly dispersed in the heavy oil.

The present invention is hereinbelow described in detail.

In the present invention, there is used a water/carbon mixture component prepared by dispersing carbon fine particles in water with a dispersant and a protective colloid. As carbon fine particles, carbon black, lamp soot, torch smoke, soot and the like can be given. An India ink prepared by dispersing the carbon fine particles in water by suitably using a protective colloid such as glue and gelatine and a dispersant such as sulfonic acid salt of naphthalene formalin condensate is preferable as a water/carbon mixture component of the present invention. An India ink having particle diameters of carbon fine particles specified within a specific range can be preferably employed as described later. In addition, there may be used an India ink obtained by rubbing in water an ink stick prepared by coagulating lamp soot, torch smoke, soot or the like with glue. Further, there may be used an ink prepared by dispersing carbon fine particles such as carbon black, lamp soot, torch smoke, and soot by appropriately using protective colloids such as glue and gelatine and a dispersant of sulfonic acid salt of naphthalene formalin acid condensate or the like, and dispersing it with a ball mill and a roll to be ground or diluted with water.

It is preferable that the carbon fine particles are so small that diameters are within about 0.01–0.3 $\mu$m. By agitating and mixing in heavy oil a thing in which the carbon fine particles are dispersed with a dispersant and a protective colloid, the carbon fine particles which adsorbed a protective colloid surround an interface of a water particle, a heavy oil portion having high-molecular polarity among heavy oil components surrounds the carbon fine particles, and a strong interface is formed around a water particle. Thus, water-in-oil type emulsion fuel oil is produced.

Incidentally, water to be used in the present invention is not particularly limited. Normal city water, water for industrial use, or the like can be used, and, in addition, well water, river water, wetlands water and seawater can be used, too.

In emulsified fuel oil of the present invention, a water/carbon mixture component is mixed in the range of 20–45 vol % with 100 vol % of heavy oil. The water particles which were dispersed and emulsified in the heavy oil have particle diameters of from more than 20 $\mu$m to 35 $\mu$m. In addition, in emulsified fuel oil of the present invention, agitation and dispersion are performed so that particle diameters of water particles are within the range from 25 $\mu$m to 35 $\mu$m in a case that a mixture ratio of a water/carbon mixture component to heavy oil is in the range from 20 to 35 vol % and: that particle diameters of water particles are from more than 20 $\mu$m to 25 $\mu$m in a case that a mixture ratio of a water/carbon mixture component to heavy oil is in the range from 35 to 45 vol %.

That is, as a mixture ratio of heavy oil increases in the above range, the particle diameter of a water particle becomes larger, and, on the contrary, as a mixture ratio of heavy oil decreases in the above range, the particle diameter of a water particle becomes smaller. Thus, by specifying mixture ratio of heavy oil and a water/carbon mixture component and particle size of a water particle, water particles are dispersed uniformly in heavy oil, and the carbon fine particles which adsorbed a protective colloid surround an interface of the water particles mentioned above, and a heavy oil portion of a high-molecule and a polarity among heavy oil components surrounds them to form a strong interface around a water particle. Thus, water-in-oil type emulsion fuel oil is produced.

In the case that a mixture ratio of a water/carbon mixture component is so small as 20–35 vol %, particle diameters of water particles are made within the aforementioned range by reducing frequency and time of agitation. On the other hand, in the case that a mixture ratio of a water/carbon mixture component is so large as 35–45 vol %, particle diameters of water particles are made within the aforementioned range by increasing frequency and time of agitation.

The most preferable example of emulsion fuel oil of the present invention is the one in which 30 vol % of a water/carbon mixture component is mixed with 100 vol % of heavy oil, and agitation and dispersion are performed so that dispersed and emulsified water particles in heavy oil have particle diameters of about 30 $\mu$m in order to disperse water particles uniformly in heavy oil.

Such a state of water-in-oil type is extremely stable, and heavy oil and water are not separated or are not isolated for a long term.

A state of a water-in-oil type in the present invention is described by the use of drawings.

FIG. 1 schematically shows a state of circumference of a water particle in emulsified fuel oil of the present invention. The circumference (an interface) of a water particle 1 which is dispersed in heavy oil is surrounded by a water phase 2 which contains a protective colloid such as glue affluently. Carbon fine particles 3 adsorbs on the entire surface in water phase 2, and a heavy oil portion 4 of a high-molecule and a polarity among heavy oil components surrounds the circumference, thereby a strong interface is formed around the water particle 1. Incidentally, a matrix phase of this emulsified fuel oil is a heavy oil phase 5.

Figure 2:
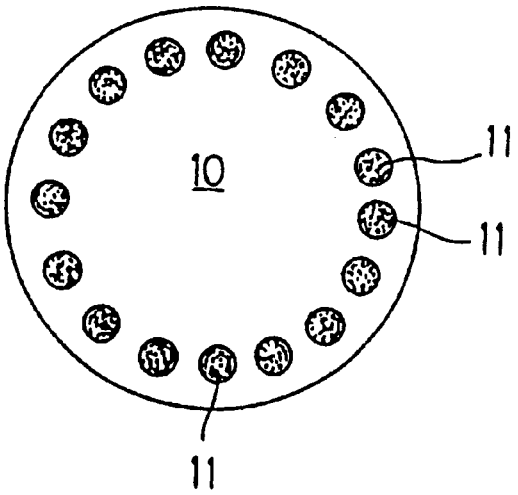
FIG. 2 is the conception diagram schematically showing a state of circumference of a water particle in emulsified fuel oil made by the use of a conventional surface active agent.

FIG. 2 schematically shows a state of circumference of a water particle of emulsified fuel oil produced by the use of a conventional surface active agent. In this case, heavy oil 11 disperses in the form of fine particles in a peripheral portion of a water particle 10. As a result of present inventors' confirmation by an experiment, it was found that separation of heavy oil and a water component is caused under the long-term storage.

Because the emulsified fuel oil of the present invention is a water-in-oil type emulsified fuel oil having such a form, it has good points that a water particle is stably held in heavy oil and that the combustion efficiency is extremely high.

Next, a description is made on combustion by the use of the emulsified fuel oil of the present invention.

When the emulsified fuel oil of the present invention is combusted with a burner, oil drops spout out from the burner are combusted by being subjected to heat. At the same time, water particles in the oil drops are subjected to radiant heat, too, heated rapidly, and explosively and instantly vaporized to be steam a steam volume is about 1000 times of water). At this time, oil drops are changed into fog of fine particles by means of vaporization to steam of water particles (this phenomenon can be referred to as micro-explosion), and therefore, both heat transmission and evaporating and gasification are rapid. Thus, reaction with oxygen becomes easy, and it is very easy to combust, and therefore, a combustion state can be kept well.

In the present invention, there is used a water/carbon mixture component dispersed in heavy oil prepared by adding carbon fine particles at the rate of 0.3–0.001 weight % to water as carbon fine particles and mixing with water. Generally, it is about 0.1–0.01 weight %. These ratios can be changed depending on quality of heavy oil, a moisture content or a storage period of emulsified fuel oil, or the like.

Since it is thus getting off with use of an extremely little quantity, it is preferable in convenience of work that a slight dense water/carbon mixture component (hereinbelow referred to as dispersion liquid) is prepared beforehand, and predetermined quantity of this dispersion liquid is added to water when the present emulsified fuel oil is used.

In addition, as dispersants and protective colloids to be used when carbon fine particles are dispersed in water in the present invention, the followings can be nominated.

As dispersants there are, for example, sulfonic acid salt of a naphthalene formalin condensate, sulfonic acid salt of an aromatic polycyclic condensate, triazine based dispersant, lignin based dispersant. As protective colloids there are, for example, glue, gelatine, albumin, an alkali salt of casein, carboxymethylcellulose, methyl cellulose, hydroxyethylcellulose, poly(vinyl alcohol), polyvinyl pyrrolidone, a polyacrylic salt, and polyacrylamide.

Heavy oil to be used in the present invention is heavy oil such as C heavy oil specified with JIS K 2205 and heavy oil such as heavy residue oil which is heavier than C heavy oil. That is, it is heavy oil such as residue oil abundantly containing asphaltene, resins, heavy metals except for A heavy oil and B heavy oil.

In addition in the present invention, emulsification temperature of heavy oil is not particularly limited; and even at normal temperature and even if quality of heavy oil is variant, it can be emulsified.

As a temperature of a water/carbon mixture component, room temperature is used. Though it may be heated, good emulsification can be generally obtained without heating.

To disperse and emulsify a water/carbon mixture component in heavy oil, it is enough to agitate and mix both of them in a normal agitation device. It is enough to pour heavy oil and a water/carbon mixture component into, for example, a mixture tank provided with a suitable agitator and agitate and mix them.

Various kinds of agitating-mixing devices can be employed. For example, various kinds of agitator-mixers such as a feather type, a paddle type, a propeller type, a spiral type and a spiral ribbon type can be employed.

As a method to mix and disperse a water/carbon mixture component in heavy oil with an agitating-mixing device, there may be employed a method in which a water/carbon mixture component is added to heavy oil at once to mix them or a method in which a water-carbon mixture component is gradually added. Or, heavy oil and a water/carbon mixture component may be added at the same time to be mixed.

EXAMPLE

An example With regard to combustion of emulsified fuel oil of the present invention is hereinbelow described specifically.

EXAMPLE 1

There was used a water/carbon mixture component (a mixture ratio of carbon to water is 0.01 weight %) which was prepared by dispersing carbon fine particles having particle diameter of 0.1 $\mu$m with using glue and sulfonic acid salt of a naphthalene formalin acid condensate. This water/carbon mixture component was mixed with C heavy oil having properties shown in table 2 with various rates of water to be added (quantity of addition (volume %) of water to heavy oil 100), and it was agitated and mixed by a propeller type agitator to disperse and emulsify a water/carbon mixture component in C heavy oil, thereby a series of water-in-oil type emulsified fuel oil of the present invention was produced.

About thus obtained emulsified fuel oil, particle diameters of the water particles which were dispersed and emulsified in C heavy oil were measured. The diameters were about 35 $\mu$m in the case that the rate of water was 20%, about 30 $\mu$m in the case that the rate of water was 30%, and about 21 $\mu$m in the case that the rate of water was 45%.

Next, a series of the obtained emulsified fuel oils was subjected to combustion in conditions shown in table 1 with a combustion rate of 150 l/hr. Incidentally, the emulsified fuel oil was poured into a measuring cylinder of 5ml, and it was let alone at temperature of 40–50° C. and room temperature, and separation of water and presence of isolation were examined respectively from microscope examination of emulsified fuel oil and from the appearance of a measuring cylinder after one week and after one month, but separation or isolation of water was not found, and the dispersion state of water was good.

Then, the emulsified fuel oils obtained as described above were subjected to a combustion test using a known boiler. The results are shown in Table 1.

These emulsified fuel oils continued stable combustion, and there was no problem. In addition, as is clear from a result of Table 1, the flame temperature upon combustion of them has almost no difference in comparison with that for the rate of water of 0%, and it can be understood that they are excellent in combustibility. It was further recognized that a fall of flame temperature was not found though a quantity of particulates was decreased by addition of water.

TABLE 1

| | | $O_2$ = 2% Combustion | | $O_2$ = 4% Combustion | |
|---|---|---|---|---|---|
| | Water (%) | Particulates mg/Nm$^3$ | Flame Temperature ° C. (at mouth of burner) | Particulates mg/Nm$^3$ | Flame Temperature ° C. (at mouth of burner) |
| C HEAVY OIL | 0 | 31.2 | 1283 | 18.2 | 1346 |
| Quantity of | 20 | 21.5 | 1288 | 5.9 | 1357 |
| atomized steam | 30 | | | — | 1255 |
| = 60 l/h | 45 | 15.1 | 1267 | 12.8 | 1306 |
| C HEAVY OIL | 0 | | | — | 1292 |
| Quantity of | 20 | — | 1232 | | |
| atomized steam | 30 | | | — | 1257 |
| = 30 l/h | 45 | | | — | 1248 |

TABLE 2

| Test Item | | C Heavy Oil |
|---|---|---|
| Density | g/cm$^3$ | 0.9582 |
| Pour Point | ° C. | −2.5 |
| Flash Point | ° C. | 110 |
| Kinematic Viscosity (50° C.) | mm$^2$/s | 190 |
| Kinematic Viscosity (100° C. ) | mm$^2$/s | 24.89 |
| Sulfer | mass % | 2.85 |
| Nitrogen | mass % | 0.18 |
| Residual Carbon | mass % | 11.2 |
| Ashes | mass % | 0.01 |
| Sediment and water | mass % | 0.05 |
| Total Calorific Value | J/g | 43,120 |
| Metal Fe | mass ppm | 1 |
| Na | mass ppm | 2 |
| Ni | mass ppm | 7 |
| V | mass ppm | 21 |

INDUSTRIAL APPLICABILITY

According to emulsified fuel oil of the present invention, it is extremely profitable in view of a heat balance because its flame temperature does not change in comparison with that of the heavy oil combustion to which water is not added. In addition, because a volume of oil to be combusted decreases, carbon dioxide ($CO_2$) to be exhausted is consequently decreased and therefore, the emulsified fuel oil is preferable for inhibiting global warming.

Further, emulsified fuel oil of the present invention has a good and stable dispersion state of water and no separation or isolation of water and, therefore, can be stored for a long term.

What is claimed is:

1. A water-in-oil emulsion fuel oil, prepared by dispersing and emulsifying in a heavy oil a water/carbon mixture prepared by dispersing carbon fine particles in an amount of 0.3 to 0.001 weight % in water with a dispersant and a protective colloid, the emulsion fuel oil comprising 100 vol % of a heavy oil and 20 to 45 vol % of the water/carbon mixture, the water being uniformly dispersed and emulsified in the heavy oil in the form of particles having diameters of from more than 20 to 35 $\mu$m.

2. A water-in-oil emulsified fuel oil according to claim 1, wherein carbon fine particles which adsorbed a protective colloid surround an interface of a water particle, and heavy oil having a high-molecule and a polarity among heavy oil components surrounds a circumference of the carbon fine particles to form a rigid interface around the water particle.

3. A water-in-oil emulsified fuel oil according to claim 2, wherein 30 vol % of a water/carbon mixture component is mixed with 100 vol % of heavy oil, and water particles dispersed and emulsified in heavy oil are agitated and dispersed so an to have a particle diameter of about 30 $\mu$m, and water particles are uniformly dispersed in the heavy oil.

4. A water-in-oil emulsified fuel oil according to claim 1, wherein the carbon fine particles have particle diameters of 0.01–0.3 $\mu$m.

5. A water-in-oil emulsified fuel oil according to claim 1, wherein the amount of the water/carbon mixture to be mixed with 100 vol % of the heavy oil is 20 to 35 vol % and the dispersed water particles have diameters ranging from 25 to 35 $\mu$m.

6. A water-in-oil emulsified fuel oil according to claim 1, wherein the amount of the water/carbon mixture to be mixed with 100 vol % of the heavy oil is 35 to 45 vol % and the dispersed water particles have diameters ranging from more than 20 $\mu$m to 25 $\mu$m.

* * * * *